US010304427B2

(12) United States Patent
Mudrenov

(10) Patent No.: US 10,304,427 B2
(45) Date of Patent: May 28, 2019

(54) LASER TRIGGER FOR BASS DRUM

(71) Applicant: Ilya Yuriyevich Mudrenov, Moscow (RU)

(72) Inventor: Ilya Yuriyevich Mudrenov, Moscow (RU)

( * ) Notice: Subject to any disclaimer, the term of this patent is extended or adjusted under 35 U.S.C. 154(b) by 0 days.

(21) Appl. No.: 16/099,502

(22) PCT Filed: Apr. 28, 2017

(86) PCT No.: PCT/RU2017/050032
§ 371 (c)(1),
(2) Date: Nov. 7, 2018

(87) PCT Pub. No.: WO2017/200427
PCT Pub. Date: Nov. 23, 2017

(65) Prior Publication Data

US 2019/0108820 A1 Apr. 11, 2019

(30) Foreign Application Priority Data

May 20, 2016 (RU) ..... 2016119607

(51) Int. Cl.

| | |
|---|---|
| ***G10D 13/02*** | (2006.01) |
| ***G10D 13/00*** | (2006.01) |
| ***G10H 3/14*** | (2006.01) |
| ***G10H 1/34*** | (2006.01) |

(52) U.S. Cl.
CPC ..... *G10D 13/006* (2013.01); *G10D 13/027* (2013.01); *G10H 1/348* (2013.01); *G10H 3/146* (2013.01); *G10H 2220/421* (2013.01)

(58) Field of Classification Search
CPC .... G10D 13/006; G10D 13/027; G10H 1/348; G10H 1/146
See application file for complete search history.

(56) References Cited

U.S. PATENT DOCUMENTS

| | | | | |
|---|---|---|---|---|
| 4,819,536 | A | 4/1989 | Lombardi | |
| 5,453,567 | A * | 9/1995 | Brinson | G10D 13/00 84/104 |
| 7,598,445 | B1 * | 10/2009 | Johnston | G10H 1/348 84/411 R |
| 8,278,541 | B2 | 10/2012 | Dorfman et al. | |
| 9,263,009 | B2 * | 2/2016 | Lee | G10D 13/006 |

(Continued)

OTHER PUBLICATIONS

Search report in PCT/RU2017/050032, dated Aug. 17, 2017.

*Primary Examiner* — Robert W Horn
(74) *Attorney, Agent, or Firm* — Bardmesser Law Group

(57) ABSTRACT

A laser trigger for a bass drum includes an enclosure attached to a drum rim which contains at least one reader of strokes performed with a foot pedal beater. The stroke reader is directed towards the beater, and has a laser beam emitter and the photoelectric element, whereas the retroreflective coating is applied on the pedal beater to reflect the laser beam in the direction of the photoelectric element at the moment of stroke. The enclosure/housing cavity includes a stroke recognition circuit based on parameters of the electric signal from the photoelectric element connected with the processing circuit that includes an audio frequency electric signal generator, which is connected with the output connector to connect the cable for outputting these signals for further processing and amplification.

4 Claims, 3 Drawing Sheets

(56) References Cited

U.S. PATENT DOCUMENTS

| | | | | |
|---|---|---|---|---|
| 9,761,212 | B2 * | 9/2017 | Suitor | G10H 3/146 |
| 10,096,309 | B2 * | 10/2018 | Suitor | G10H 3/188 |
| 2018/0174556 | A1 * | 6/2018 | Steinhauser | G10H 3/146 |

* cited by examiner

LASER TRIGGER FOR BASS DRUM

BACKGROUND OF THE INVENTION

Field of the Invention

The present invention relates to the field of musical equipment, particularly, it provides an operating principle and structure of a device ensuring recognition of strokes performed by a musician when he plays a bass drum and generation of electric signals of audio frequencies.

Description of the Related Art

In contrast to a microphone, there are devices that do not transmit sounds of an acoustic drum, but perform replacement thereof with pre-arranged audio signals reproduced from the database. Such a device is called a "drum trigger" in the community of professional musicians.

Development of electric musical instruments and electro-acoustic transmission methods of sounding of performers has been taking place starting from the 1950s. The number of different musical styles and genres, where electric musical instruments and electric musical equipment are applied, is also growing. In addition to such development, a change in subjective perception of balanced sounding and instrument tone qualities by listeners is observed. The significant role in sounding of the modern popular music is allocated to the rhythm section, whose basis is a combination of a drum and a bass guitar (or another bass instrument). In most cases, professional musicians tend to choose acoustic drum kits for their activities. This is mainly due to the fact that over years of musical practice drummers acquire the articulation technique specific to acoustic drums and the habit to hear natural sounding of acoustic drums when playing. Moreover, many modern styles of electronic music performed live require the sound of a bass drum to be very intense, and concert sounding of a musical band to be as close as possible to sounding like an album recorded in a studio using complex sound processors.

During studio processing, sounding of an acoustic drum picked up by a microphone undergoes significant changes, so that the sound of a bass drum can fit well into the common balance, is easy to listen, and also does not cause overloads. If required by the music style, the sound of a bass drum is often made artificial and manifestly electronic. It is quite difficult, and in some cases nearly impossible, to perform such signal processing at live concerts. The technique of replacement of the actual drum sound with the pre-arranged sample sound (so called "sample"), which is reproduced at the time of stroke from the memory of the special device, i.e., a so called "sound module", is used for solving such problems at live concerts.

Currently there are known technical solutions (WO 2009140368, U.S. Pat. Nos. 7,642,448, and 7,491,880) for use in keyboard musical instruments which allow transforming the instrument sound into its digital form in isolation of the ambient environment and sounds of surrounding musical equipment, for the purpose of electronic processing and transmission to an acoustic broadcaster. An exemplary conventional device includes a light emitter (light-emitting diode), a signal recognition module, a memory of an audio signal waveform storage, an audio signal reproduction module, controls, and a power supply. Tracking of a movable mechanism (hammer, key) is performed using emitters and receptors of light reflected or crossing the trajectory of movement thereof.

U.S. Pat. No. 8,013,233 provides a structure of a device with an optical pickup for keyboard instruments comprising an optical emitter and a sensor, as well as a reflecting plate. Furthermore, a pattern in the form of continuous gradient of gray color or alternation of different tones thereof may be applied on the plate. These solutions make it possible to transform each key movement into the corresponding sound file which is then broadcasted through an acoustic broadcaster to the ambient environment.

However, known solutions cannot easily be applied to solve the problem of insonation of an acoustic drum, since they require special retrofitting of a musical instrument (i.e., introduction of sound pickup elements into the structure of a musical instrument), which is rather difficult, and sometimes even impossible under conditions of music festivals, in club and touring activities, when there is a conventional drum set on the stage, and there is no time to retrofit it (which involves replacement of a rim, mounting of brackets, and performance of other mechanical operations). Regarding such a musical instrument as a drum, a change in its structure presents a serious problem, because its structure does not provide for changes at all. The similar previously patented solutions require availability of a sensor installed directly in a pedal (or key) mechanism. Installation of an additional sensor in the pedal mechanism will always be associated with quite complex mechanical works. In case of the similar solutions, the pedal mechanism which has been modified will certainly cease to be original, and its manufacturer's warranty will be canceled.

All drums use some mechanical pulse for transformation thereof into sound. This pulse provides a stroke of a drumstick or a foot pedal beater on a special surface. Such a surface in acoustic drums is made of plastic material which vibrates due to a stroke and generates sound waves amplified by a resonator. A circuit including a drum itself, a trigger, connecting cables, and a sound module representing a generator of pre-arranged electric signals of audio frequencies, is used conventionally to replace sounds of an acoustic drum with sounds from the sound module. In particular, the trigger plays a critical role in this chain: it receives the beat data.

Generally, a modern drum trigger for an acoustic drum represents a piezoelectric element located in a body mounted on a drum rim (see U.S. Pat. No. 6,794,569B2, published on Nov. 21, 2004). Vibration and deformation of the drum plastic surface in the process of drum sounding creates an electric signal by means of the piezoelectric effect. This signal is output from a trigger with a cable and sent to a special electronic device which recognizes the beat event and force according to signal parameters. As soon as the beat is detected, and its force is assessed, a command to playback a "sample", i.e., the final signal of a musical instrument previously recorded and placed in the database of the sound module, is formed.

The above solution has a number of disadvantages due to the fact that, apart from beat data, the electric signal from the piezoelectric element carries too much unnecessary information created by long-standing overhang of an acoustic drum (so called "sustain") and acoustic pickups to the drum from the adjacent sound sources. In order to ensure perfect operation of the trigger at each beat, it requires a single and sufficiently short pulse carrying data on the beat event and force. Unfortunately, the piezoelectric element sends a complex long-standing signal with a large amount of unnecessary information. This results in a problem of beat data extraction from this signal.

Several beat recognition methods are applied to solve this particular problem. One of them is a threshold detector which activates only when the signal level from the piezoelectric element exceeds a preset threshold. This method has some disadvantages: it requires customization of the threshold level, and also causes insensitivity to the beats, where the level of the signal from the piezoelectric element does not reach the threshold. On the other hand, if the threshold is set at a low level, false activations appear, when not only the initial pulse at the beat reaches the threshold, but so do the other oscillations of the plastic surface caused by instrument overhang and surrounding noise.

A second method is to analyze the signal from the piezoelectric element by means of digital signal processing. It is more efficient than the threshold one, but also has certain disadvantages: it is quite demanding of the processor computation capacity, continuously processing the original signal in real time, whereas the main disadvantage of this method is the substantial delay, namely the time interval from the beat performed by a musician until recognition of that beat by the processor. Professional musicians become aware of these delay intervals and feel uncomfortable when playing on an instrument.

SUMMARY OF THE INVENTION

The present invention allows to achieve the technical result ensuring reliable recognition of strokes performed by a musician on a bass drum using a foot pedal without the above mentioned disadvantages (insensitivity to weak strokes, false activations, and delay).

The laser trigger for the bass drum includes an enclosure attached to the drum rim which contains at least one reader of strokes performed with the foot pedal beater at the bottom portion. The stroke reader including the laser beam emitter and the photoelectric element is directed towards the beater, and the retroreflective coating is applied on the pedal beater head to reflect the laser beam in the direction of the photoelectric element at the moment of stroke. The cavity of this enclosure accommodates the stroke recognition circuit based on parameters of the electric signal from the photoelectric element connected with the processing circuit including the audio frequency electric signal generator which is connected with the output connector to connect the cable for the purpose of output of these signals for further processing and amplification.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
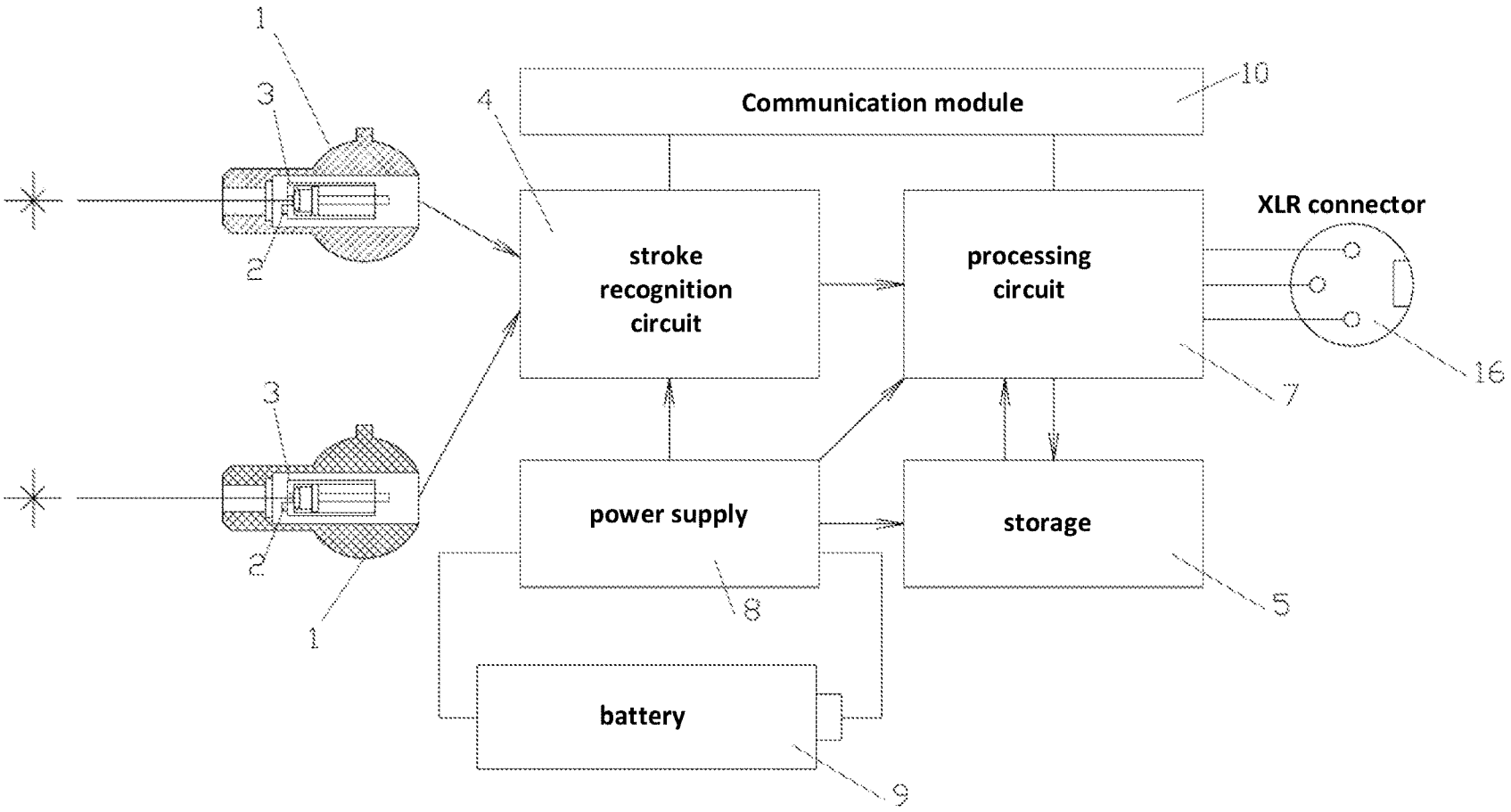
FIG. 1 shows a block diagram of a laser trigger for a bass drum.

Reference will now be made in detail to the preferred embodiments of the present invention, examples of which are illustrated in the accompanying drawings.

The present invention provides a structure of the laser trigger device designed for picking up the sound of the bass drum at electronic music concerts and in studios. The device can be used instead of the usual microphone or together with the microphone. The bass drum means the drum, hitting whereon is performed by way of tilting the foot pedal which carries the beater. When pushing the pedal, the beater, pinned with the possibility of swinging, deflects to the acoustic membrane of the drum and hits it. The beater travel speed immediately before contact with the membrane determines the force and amplitude of the sound wave emitted by the drum into the ambient environment.

The laser trigger includes the enclosure attached to the bass drum rim, which contains at least one reading head, including the laser beam emitter and the photoelectric element located in the output area of this beam at the bottom portion directed towards the beater head. The sticker made of the retroreflective material is attached onto the beater head for the purpose of reflecting the laser beam in the direction of the photoelectric element at the moment of the beater striking the acoustic membrane. The enclosure cavity accommodates the stroke recognition circuit based on the electric signal from the photoelectric element connected with the pulse processing circuit that includes an audio frequency electric signal generator, which is electrically connected with the connector to connect the cable for the purpose of transmission of the signal to external acoustic systems used for sound amplification.

The audio frequency electric signal generator may be represented by a wave synthesizer or a physical modeling sound synthesizer.

The audio frequency electric signal generator based on the wave synthesizer is made as a software module implemented within the microcontroller. The module output receives commands from the stroke recognition circuit. While in operation, the wave synthesizer addresses the memory chip, where the waveform database is stored in the digitized form. Serial reading of digital values, scaling thereof according to the stroke force, and serial output to the chip of the digital-to-analog converter, at the output whereof the continuous electric signal of audio frequency is obtained, are performed when the drum is played.

The audio frequency electric signal generator based on the physical modeling sound synthesizer is made, for example, as a software module implemented within the microcontroller, or, optionally as a firmware, an ASIC or FPGA. The module input receives commands from the stroke recognition circuit. The physical modeling sound synthesizer addresses the mathematical model of the musical instrument in the course of operation. Serial reception of digital values as a result of cyclic computation of the discretized equation which accepts the stroke event and force, as well as the set of variable values assigned by custom settings as arguments, are performed during reproduction. The obtained computational results are outputted in series to the chip of the digital-to-analog converter, at the output whereof the continuous electric signal of audio frequency is obtained.

An example of a specific embodiment of the invention is described below with reference to the drawings.

Figure 2:
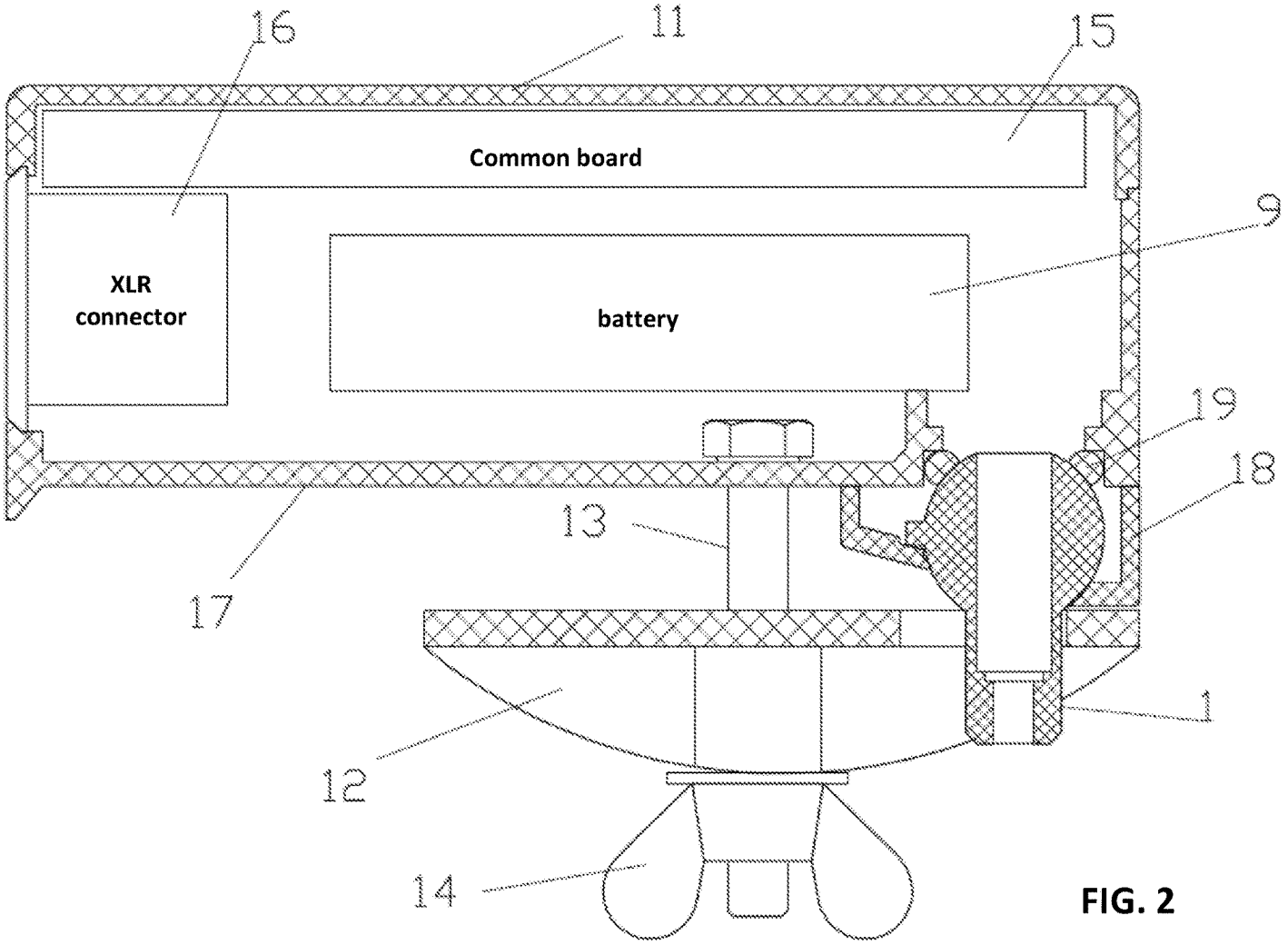
FIG. 2 shows a structural diagram of a laser trigger.
Figure 3:
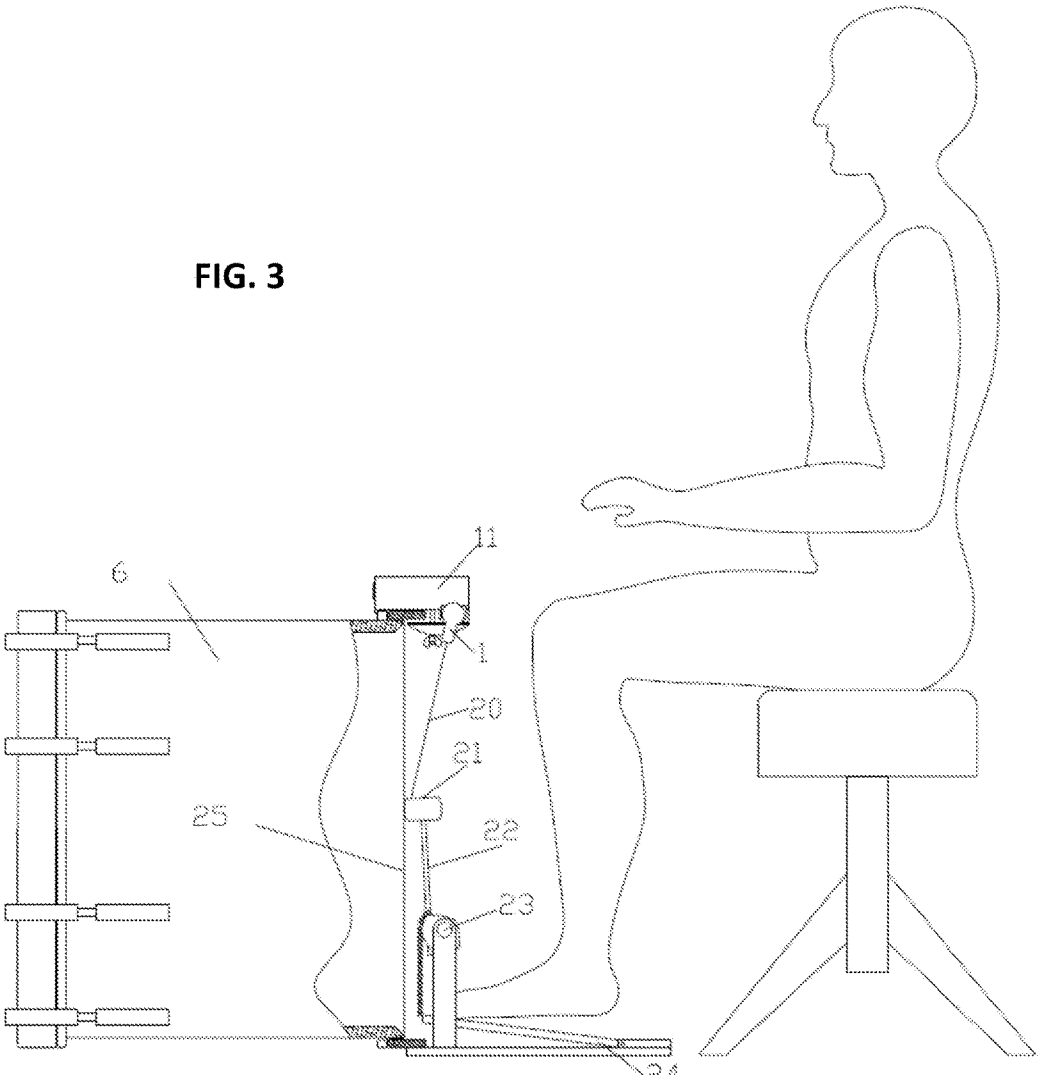
FIG. 3 shows an arrangement of a device on a bass drum.

As shown in FIG. 1, the devices comprises the following parts: the reading head 1 (or several reading heads) including the photoelectric element 2 and the laser beam emitter 3, the stroke recognition circuit 4, the audio signal waveform database storage 5, the processing circuit 7 including the audio frequency electric signal generator, as well as controls and indication elements, the switching mode power supply 8, the electric battery 9, the communication module 10, and the enclosure 11. All device components are combined in the enclosure 11 having the clamp 12 for attachment thereof to the bass drum rim (FIGS. 2 and 3). This mechanism can be made in the form of a C-clamp installed on the rim edge and attached using the bolt 13 carrying the wing nut 14. Electronic circuits (the stroke recognition circuit 4, the database storage 5, the processing circuit 7 including the audio frequency electric signal generator, etc.) are mounted on the common board, to thereby collectively form a single unit 15.

The present device fulfills several functions. The electronic board and the power supply element (battery) are positioned within the enclosure. The front panel allows the user to visualize the operation process and set operating parameters (by using the controls and indication elements on the surface thereof). The XLR connector 16 is installed on the rear side of the enclosure for connection of the signal cable. The lower housing 18 for fitting of two hinge joints, each of which accommodates the reading head 1 carrying the laser beam emitter and the photoelectric element, is formed on the lower side 17 of the enclosure, where there is an attachment mechanism, i.e., a clamp for installation of the device on the bass drum rim. The hinge joint is spring-loaded with the O-ring 19 which makes it fixed when playing, and provides the possibility by applying the force of a finger to deflect the reading head 1, as well as the laser beam 20 in two degrees of freedom, and point it at the desired position (in this case, at the retroreflective sticker 21 positioned on the upper surface of the beater head 22 at the time of contact thereof with the plastic surface 25 of the bass drum). The standard beater is connected with the foot pedal 24 by the hinge 23. There is a window allowing to replace the battery without removing the instrument from the drum on the side of the enclosure 11.

The operating principle of the device is based on tracking of the position of the bass drum pedal beater using the laser beam. The beater is equipped with the coating made of retroreflective material. The reading head comprises the laser beam emitter and the photoelectric element. The laser beam is pointed in such a manner so as to fall on the reflective material at the time of stroke. Owing to the properties of the retroreflective material, the laser beam is reflected and pass back to the reading head, where it falls to the photoelectric element located in the maximum vicinity to the emitter outlet port. The electronic circuit recognizes the stroke event according to the signal from the photoelectric element. This signal is processed, after which the command is generated for the wave synthesizer to playback the previously recorded audio signal.

There are two operational modes:

If performance does not require transmission of the stroke force, and all sounds have to be the same in terms of volume (amplitude), then each appearance of the beater with the retroreflective coating in the path of the laser beam will result in the command to reproduce the sound.

For performance of musical composition, where transmission of dynamics is required, when the command to reproduce the sound has to differ and depend on the stroke force, the other operation mode of the instrument is implemented: a certain pattern is applied on the retroreflective surface (e.g., a stripe). The retroreflective material appears in the beam path during the stroke not on a single occasion, but discontinuously, being masked by the pattern. This causes repeated front of the electric signal from the photoelectric element, as well as the sequence of pulses according to the pattern. When processing the signal from the photoelectric element, the electronic circuit recognizes the sequence of pulses and assesses the speed thereof. The stroke force is defined by that speed, and the command to reproduce the sound is generated: the higher the pulse sequence speed, the stronger the stroke.

The structural design provides for availability of fitting one or two reading heads within the single device. This makes it possible to operate both the single and stereo pedals.

The enclosure (housing) includes the built-in communication module 10 for control and service using the external electronic device which can be a computer, a tablet PC or a smartphone. After connecting to this device, the user is able to visualize device operation remotely, control basic parameters, download files with sound waveforms, and gains access to configuration parameters. It is now possible to update the internal device firmware. One of advantages of the claimed invention is that the device does not require any retrofitting of a musical instrument, since it is attached to the conventional rim of the bass drum. This makes the device suitable for quick installation, literally in one minute.

The device is an accessory to a musical instrument, and its presence does not affect functioning and sounding of the instrument in any way. There is no need to interfere with the foot pedal mechanism or replace any drum parts. Therefore, a musician who got used to playing on his/her instrument and using his/her pedal will not feel uncomfortable due to strangeness of perception. Given invention represents a functionally complete product and is ready for operation immediately after attachment to the conventional drum rim. The combined "all-in-one" solution allows omitting assembly of the circuit from separate units and connecting cables, thus saving time significantly and improving reliability. Battery power supply allows for independent operation and removes the need to search for an AC connection.

Having thus described a preferred embodiment, it should be apparent to those skilled in the art that certain advantages of the described method and system have been achieved.

It should also be appreciated that various modifications, adaptations, and alternative embodiments thereof may be made within the scope and spirit of the present invention. The invention is further defined by the following claims.

What is claimed is:

1. A laser trigger for a bass drum comprising:

a housing attached to a drum rim with at least one reader of strokes performed with a foot pedal beater, wherein the stroke reader is positioned in a lower portion of the enclosure and is directed towards the foot pedal beater, and comprises a laser beam emitter and a photoelectric element;

a retroreflective coating on the foot pedal beater for reflecting a laser beam in a direction of a photoelectric element at a moment of stroke; and the housing including a stroke recognition circuit based on parameters of the electric signal from the photoelectric element connected to a processing circuit, the processing circuit including an audio frequency electric signal generator which is connected to an output connector to enable further processing and amplification.

2. The laser trigger of claim 1, wherein the stroke reader is attached to the enclosure using a hinge that allows deflecting the laser beam and pointing it in a desired direction.

3. The laser trigger of claim 1, wherein the audio frequency electric signal generator is a wave synthesizer with an integrated database that has a set of digitized waveforms of previously recorded audio signals.

4. The laser trigger of claim 1, wherein the audio frequency electric signal generator is a physical modeling sound synthesizer.

* * * * *